US011684096B2

(12) United States Patent
Lee

(10) Patent No.: US 11,684,096 B2
(45) Date of Patent: Jun. 27, 2023

(54) HORIZONTALLY FLAT-FOLDABLE MASK HAVING FIVE SURFACES

(71) Applicant: In Jong Kim, Anseong-si (KR)

(72) Inventor: Sang Ho Lee, Gunpo-si (KR)

(73) Assignee: In Jong Kim, Anseong-si (KR)

( * ) Notice: Subject to any disclaimer, the term of this patent is extended or adjusted under 35 U.S.C. 154(b) by 280 days.

(21) Appl. No.: 16/771,889

(22) PCT Filed: Oct. 23, 2019

(86) PCT No.: PCT/KR2019/013936

§ 371 (c)(1),
(2) Date: Jun. 11, 2020

(87) PCT Pub. No.: WO2020/085779

PCT Pub. Date: Apr. 30, 2020

(65) Prior Publication Data

US 2021/0068478 A1 Mar. 11, 2021

(30) Foreign Application Priority Data

Oct. 26, 2018 (KR) ..... 10-2018-0128654

(51) Int. Cl.
*A41D 13/11* (2006.01)

(52) U.S. Cl.
CPC ..... *A41D 13/1115* (2013.01)

(58) Field of Classification Search
CPC .. A41D 13/11; A41D 13/115; A41D 13/1107; A41D 13/1123
See application file for complete search history.

(56) References Cited

U.S. PATENT DOCUMENTS 2,556,589 A * 6/1951 Le Duc ..... A41D 13/11 D24/110.1
3,971,369 A * 7/1976 Aspelin ..... A41D 13/1115 128/206.19
3,985,132 A * 10/1976 Boyce ..... A41D 13/1115 128/206.19
4,248,220 A * 2/1981 White ..... A41D 13/1115 128/206.16
4,300,549 A * 11/1981 Parker ..... A41D 13/1115 128/206.19
4,688,566 A * 8/1987 Boyce ..... A41D 13/1123 128/206.19

(Continued)

FOREIGN PATENT DOCUMENTS

WO WO-2008143462 A1 * 11/2008 ..... A41D 13/1115
WO WO-2011025094 A1 * 3/2011 ..... A41D 13/1115

(Continued)

*Primary Examiner* — F Griffin Hall
(74) *Attorney, Agent, or Firm* — Sughrue Mion, PLLC

(57) ABSTRACT

A horizontally flat-foldable mask includes a main body having, in a folded state, a middle lobe, an upper lobe, a lower lobe, a first fold section extending upward from the middle lobe, horizontally folded from the upper lobe and having a first mid seam line curved or inclined downward from center toward both sides, and a second fold section extending downward from the middle lobe, horizontally folded from the lower lobe and having a second mid seam line curved or inclined upward from center toward both sides, and harnesses fixed to both sides of the main body.

4 Claims, 7 Drawing Sheets

(56) References Cited

U.S. PATENT DOCUMENTS 6,484,722 B2 * 11/2002 Bostock ..... A41D 13/1161 128/206.19
7,185,653 B2 * 3/2007 Lee ..... A41D 13/1161 128/206.13
8,146,594 B2 * 4/2012 Bostock ..... A41D 13/11 128/206.13
8,251,065 B2 * 8/2012 Kim ..... A41D 13/1115 128/206.19
8,910,634 B2 * 12/2014 Lu ..... A62B 23/025 128/206.13
9,247,775 B2 * 2/2016 Suzuki ..... A41D 13/1161
9,770,057 B2 * 9/2017 Duffy ..... A41D 13/1161
D837,970 S * 1/2019 Henderson ..... D24/110.1
10,357,069 B2 * 7/2019 Tuan ..... A41D 13/1115
10,602,785 B2 * 3/2020 Duffy ..... A41D 13/1161
2005/0098180 A1 * 5/2005 Lien ..... A41D 13/1115 128/205.25
2011/0155138 A1 * 6/2011 Lin ..... A41D 13/1115 128/206.19
2014/0326245 A1 * 11/2014 Teng ..... A41D 13/1115 128/206.13
2016/0029715 A1 * 2/2016 Zheng ..... A41D 13/1161 128/863
2017/0014653 A1 * 1/2017 Duffy ..... A62B 23/025
2017/0312558 A1 * 11/2017 Wang ..... A62B 23/025
2017/0360125 A1 * 12/2017 Tuan ..... A41D 13/1169

FOREIGN PATENT DOCUMENTS

WO WO-2011052454 A1 * 5/2011 ..... A41D 13/1115
WO 2015/076538 A1 5/2015
WO WO-2015076538 A1 * 5/2015 ..... A41D 13/1115
WO WO-2015080228 A1 * 6/2015 ..... A41D 13/1115

* cited by examiner

HORIZONTALLY FLAT-FOLDABLE MASK HAVING FIVE SURFACES

CROSS REFERENCE TO RELATED APPLICATIONS

This application is a National Stage of International Application No. PCT/KR2019/013936, filed Oct. 23, 2019, claiming priority to Korean Patent Application No. 10-2018-0128654, filed Oct. 26, 2018.

TECHNICAL FIELD

The present invention relates to a mask and, more particularly, a horizontally flat-foldable mask having five surfaces.

BACKGROUND ART

As masks for protecting respiratory organs, especially filtering surface-pieces masks, there are two kinds: a cup-shaped type and a flat foldable type. The flat foldable type may be classified into a horizontally foldable type and a vertically foldable type, depending on the folding directions of plural surfaces.

A cup-shaped type mask looks like being able to accurately form an interior air chamber sealed against the exterior atmosphere with a hard structure, but it is difficult to fit most people with different face contours. Further, the mask is positioned between the jaw joints and the temples of the head because the width of the edge of the cup is limited, so it is difficult to maintain a sealed structure against movement of the facial muscles, for example, during speaking. The most serious problem is that it is difficult for the wearer to carry the mask with him due to a volume occupying a predetermined space.

Meanwhile, U.S. Pat. No. 6,394,090 disclosed a vertically foldable mask. However, as foldable masks, most are horizontally foldable types such as three-surface masks having a middle lobe, a top lobe, and a bottom lobe disclosed in Korean Patent Application Publication No. 10-1998-0702678 (International Publication No. WO/1996/028217) and Korean Patent Application Publication No. 10-1998-0702678 (International Publication No. WO/1996/028217). Further, a three-surface mask improved in shape using ultrasonic by the present inventor has been disclosed in Korean Patent No. 0966272. Further, as foldable masks, masks basically having an upper part and a lower part with a central transverse axis, wherein the upper part and the lower part with one or two folds are folded in parallel and wherein flanges bonded at an angle at both sides are connected to the transverse axis, have been disclosed by 3M in Korean Patent Application Nos. 10-2010-0091417, 10-2010-0092068 and 10-2010-0092069. In addition, a four-surface mask having A, B, C, and D sections around a central seam line has been disclosed in Japanese Patent Application No. 2010-113189 (filed on 2010 May 17).

Such foldable masks in the prior art have multi-surface structure to cover the contour of a user's surface around the nose, but the three-dimensional structures formed by three and four surfaces are limited.

Masks having five to six surfaces by the present inventor have been disclosed in Korean Patent No. 1697766 and Korean Patent Application No. 10-2018-0025688 (not published yet). The masks having five to six surfaces by the inventor are characterized in that an upper first section and a lower second section are bonded and folded along a horizontal center line. Such masks do not have a middle surface or lobe unlike existing three-surface masks.

DISCLOSURE

Technical Problem

The present inventor has completed the present invention as the result of studies on folding structures of masks and processes of manufacturing masks. The study started from a question how we can economically fabricate a mask foldable, stereoscopically adaptable to the contour of surfaces and at the same time aesthetically advantageous in use to have a middle surface (middle lobe).

Accordingly, an object of the present invention is to provide a horizontally flat-foldable mask having five lobes that can maintain three-dimensional structure similar to a hemisphere shape when used and that can be easily folded and stored.

Another object of the present invention is to provide a mask having high seal, hygienic and excellent wearing comfort.

Technical Solution

According to the present invention, there is provided A horizontally flat-foldable mask with five surfaces, the mask comprising: a main body having, in a folded state, a middle lobe, an upper lobe of which the upper end is curved or inclined downward from center toward both sides, a lower lobe of which the lower end is curved or inclined upward from center toward both sides, a first fold section extending upward from the middle lobe, horizontally folded from the upper lobe, and having a first mid seam line curved or inclined downward from center toward both sides, and a second fold section extending downward from the middle lobe, horizontally folded from the lower lobe, and having a second mid seam line curved or inclined upward from center toward both sides; and harnesses fixed to both sides of the main body. The main body of the mask of the present invention may further comprise components of the prior art in addition to the fundamental structure. For example, a casted plastic frame corresponding to a particular part of a surface may be embedded in the middle lobe when raw panel material is laminated.

In the mask of the present invention, edges of the upper lobe and the lower lobe may desirably have reinforced rims by bonding marginal portions cut out in the course of seaming the first fold section and the second fold section to the edges. The reinforced rims of the upper lobe and the lower lobe may desirably have triple thickness of a raw panel material. In the mask of the present invention, the first mid seam line of the first fold section may have a protruding grip on each side of it. The grips are formed by leaving a part of a marginal portion when the first fold section is formed by cutting a marginal portion out and seaming. The grips can be used for sanitation when handling such as unfolding the mask.

Further, according to the mask of the present invention, a shell with an opening at the center may be joined to the innermost edge of the main body to improve the feel on the surface. The shell may be made of elastic sheet.

Harnesses are generally bonded to four edges of the main body in the mask of the present invention. In addition, well-known technology of adjusting the length of a harness may be adopted.

Unless described specifically herein or otherwise, the description is based on the state in which the mask is flat folded, and the upper lobe is positioned upward when the mask is flat folded. In the present invention, the 'lobe' means main surfaces such as the middle lobe, the upper lobe, and the lower lobe of the mask, and five surfaces are achieved in addition to the previous 3 lobes by unfolding the first fold section and the second fold section to wear the mask. 'Panel' described herein means raw layered sheet material that form each surface of the mask. In general, such panel is formed by layering or laminating sheet materials with different functions. In the present invention, 'bond and cut' means that bonding and cutting are both performed. For example, if a cutting blade is disposed right after ultrasonic bonder, cutting may be sequentially performed after ultrasonic bonding, or bonding may be performed simultaneously with cutting by composite structure of an ultrasonic horn.

In the mask of the present invention, generally, the middle lobe, the upper lobe, and the lower lobe are formed by folding one panel, but they may be formed by bonding plural panels on occasions.

If necessary, a nose clip is disposed at a predetermined position on the upper lobe, and is inserted and embedded during layering to prepare a panel. The nose clip, for example, may be made of wrought iron to be freely bent by a user, or plastic material, metal with elasticity, a shape memory alloy or a shape memory plastic material. In particular, if reinforced rims are formed at the upper lobe or if a shell is additionally provided, uncomfortable feel by the nose clip is remarkably reduced.

According to the mask of the present invention, the first fold section and the second fold section are folded along the first mid seam line and the second mid seam line respectively when the mask is stored.

In a desirable embodiment of the present invention, the mask can be folded neatly because the reinforced rims of the upper lobe and the lower lobe are formed by bonding marginal portions cut out in the course of forming the first fold section and the second fold section on the corresponding edges of the upper lobe and the lower lobe respectively, and thus the folded folding sections and the reinforced rims do not overlap each other and have the same triple thickness of the raw panel when folded.

In the present invention, the panels for forming the middle lobe, the upper lobe, and the lower lobe are not limited to specific materials, and various materials such as woven fabrics and nonwoven fabrics may be used. For example, a composite fabric may be used by layering a meltblown nonwoven fabric and a spunbonded nonwoven fabric. Such a nonwoven fabric provides a function of filtering intake air by well-adjusted electrostatic micropores formed at the time of manufacture. The lining can be made of soft spunbonded nonwoven fabrics of polypropylene and polyethylene mixture.

The mid seam lines of the folding sections may be bonded by thermal fusion, particularly, ultrasonic thermal fusion when it is a nonwoven fabric, but they may be bonded by sewing or adhesion when it is a woven fabric. The horizontally flat-foldable mask of the present invention may be generally manufactured through a sequence of processes of layering (or stacking), bending, bonding (or seaming), and cutting. Further, when only one panel is used, it is easy and simple to supply and convey a panel in the manufacturing process.

The features of the present invention are more clearly revealed by closer look into a manufacturing process. After stacking sheets of various functions to prepare a mask panel, the upper and the lower part of the layered panel are folded, cut and seamed into arc shapes to form fold sections. The marginal portions cut out in this process are not removed from the panels. Further, if necessary, the protruding grips of the first folding portion are formed simultaneously. The upper and the lower portions of the folded portions are refolded again along the horizontal fold lines of the fold sections respectively. An upper lobe and a lower lobe are formed by bonding the refolded portions and the marginal portions cut out to form the fold sections. The bonded portions become the reinforced rims with a triple thickness of the raw panel. If necessary, a shell made of elastic sheet having an opening is joined to the edge of the mask on the innermost side of the mask.

The fold sections extending from the middle lobe upward and downward respectively have each arc-shaped mid seam line and each corresponding horizontal fold line. They are cut from the initial folded portions, and thus are neatly folded without overlapping the rims which are reinforced with the marginal portions cut out from the initial folded portions to be triple as thick as the raw panel.

Advantageous Effects

The mask of the present invention maintains a three-dimensional structure when used, and the middle lobe covering the mouth is parallel to the surface, and when stored, it is folded neatly without overlapping.

In addition, the upper part of the upper lobe and the lower part of the lower lobe that come into contact with the face is not just edges but reinforced rims so that the seal may be better. In addition, there is least additional cost to be incurred nor part to be removed in the middle of the process by using the margins cut out.

In addition, the mask of the present invention can be used hygienically by the grips of the first fold section and improve the feel of wearing the mask by the shell joined on the innermost side of it.

DESCRIPTION OF THE REFERENCE NUMERALS IN THE DRAWINGS

Figure 1A:
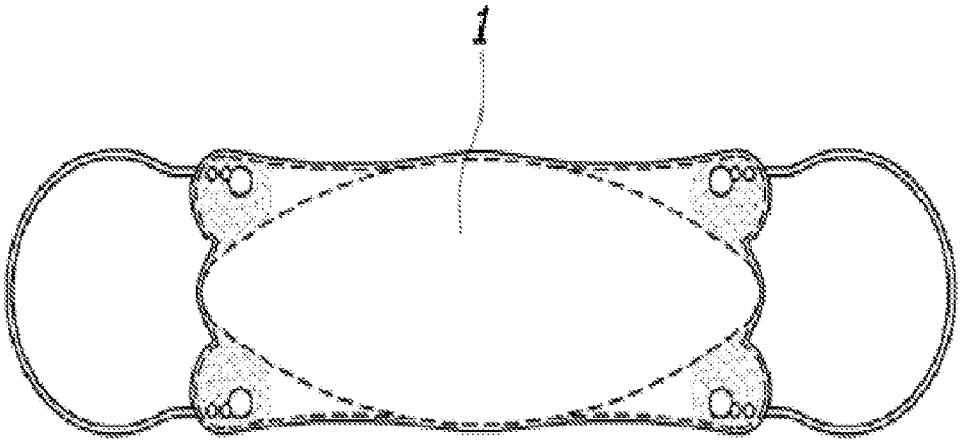
FIG. 1A (PRIOR ART)
FIG. 1A is a front view of a mask in the prior art invented by the present inventor and disclosed in Korean Patent No. 0966272 when it is folded.

1; middle lobe of a mask of prior art, 2; upper lobe of the mask of prior art, 3; lower lobe of the mask of prior art

20; mask of the present invention 21; middle lobe 22; upper lobe 23; lower lobe

24; first fold section 25; first mid seam line

26; second fold section 27; second mid seam line 30; grip

31; harness 32; harness joint 33; nose clip 34; shell

MODE FOR INVENTION

Hereafter, the present invention is described in detail with reference to the drawings. The description is for providing an example of the present invention and should not be construed as limiting the protection range of the present invention.

Figure 1B:
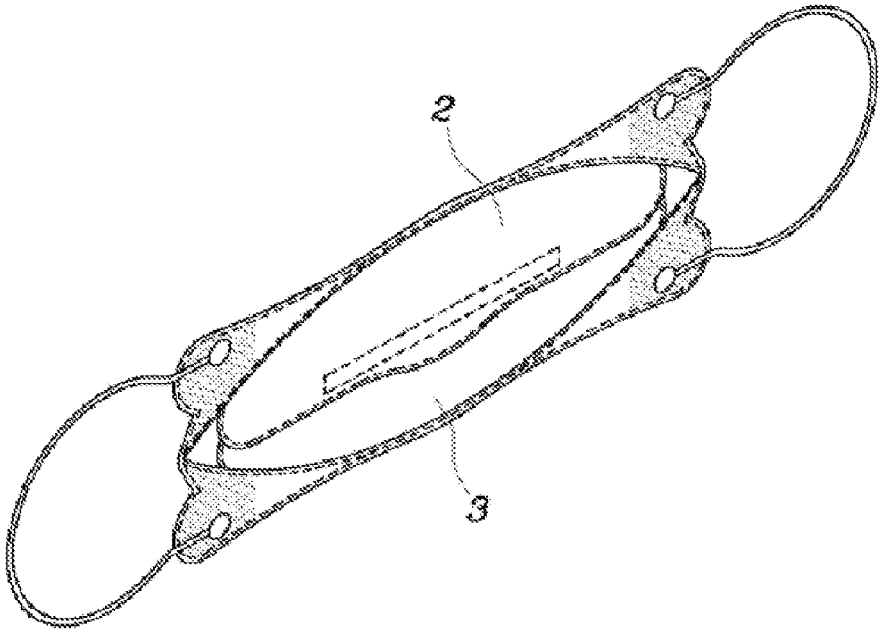
FIG. 1B (PRIOR ART)
FIG. 1B is a rear view of the mask shown in FIG. 1A.
Figure 2:
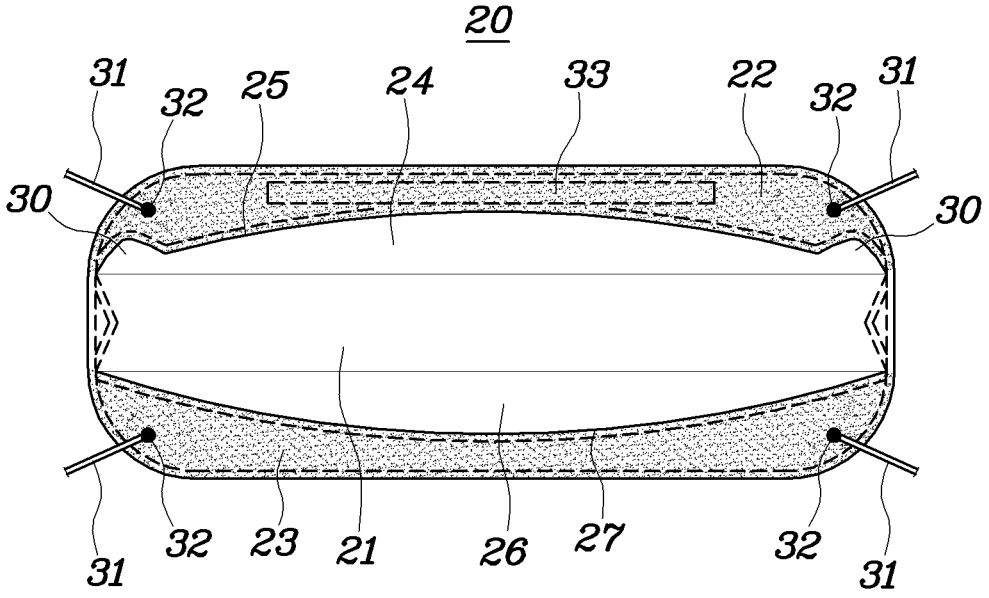
FIG. 2 is a front view of a mask in an embodiment of the present invention.
Figure 3:
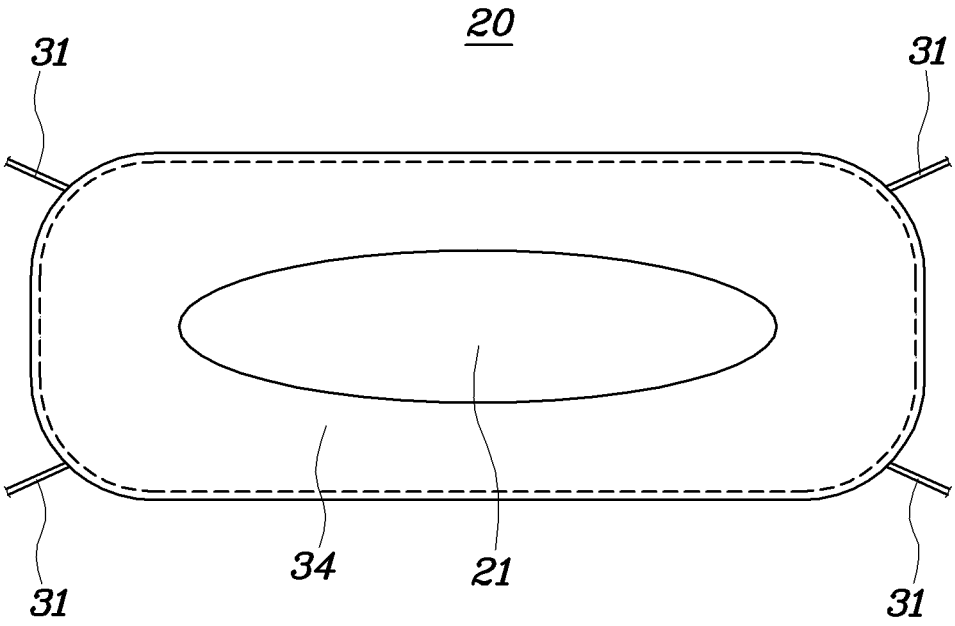
FIG. 3 is a rear view of the mask of FIG. 2.
Figure 4:
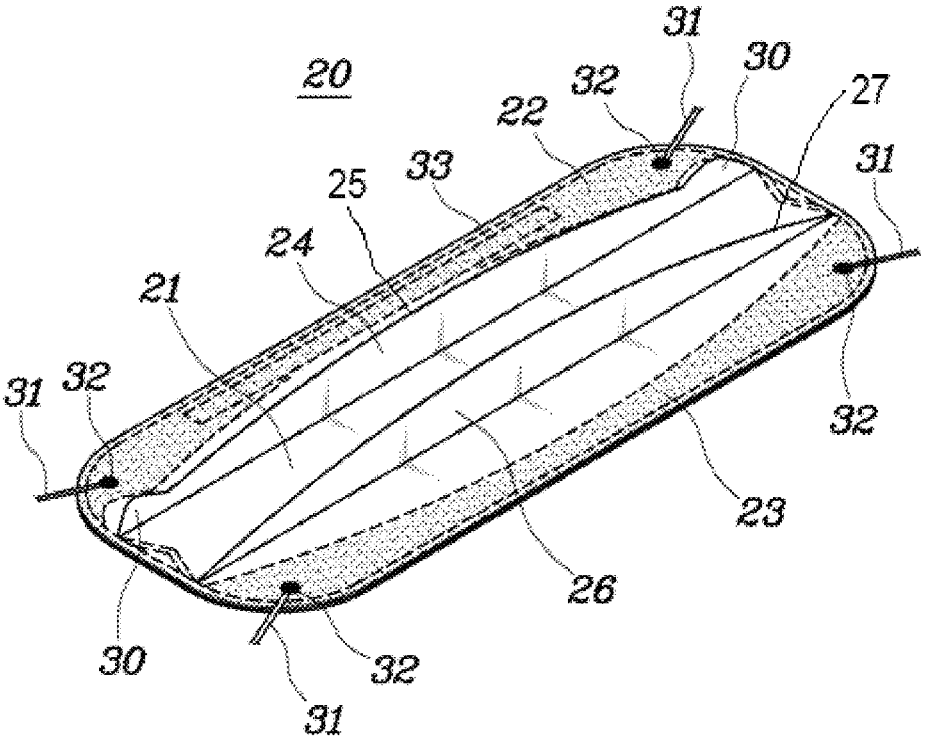
FIG. 4 is a perspective view when the fold sections of the mask shown in FIG. 2 are artificially lifted.

FIGS. 1A and 1B are respectively a front view and a rear view of a mask in prior art invented by the present inventor and disclosed in Korean Patent No. 0966272. The figures show a three-surface mask consisting of a middle lobe 1, an upper lobe 2 bonded to and bending from the upper portion of the middle lobe 1, a lower lobe 3 bonded to and bending from the lower portion of the middle lobe 1, and harnesses attached to four edges of the main body. Referring to FIGS. 2 to 6 that show an embodiment of the present invention, a main body is composed of a middle lobe 21, an upper lobe 22, and a lower lobe 23, further a first fold section 24 between the middle lobe 21 and the upper lobe 22 horizontally folded from the upper lobe 22 and having a first arc mid seam line, and still further a second fold section 26 between the middle lobe 21 and the lower lobe 23 horizontally folded from the lower lobe 23 and having a second arc mid seam line. The upper lobe and the lower lobe have rims (shaded portions) along the edges thereof respectively which are reinforced by bonding the marginal portions cut out in the course of forming the fold sections. The reinforced rims enhance the seal of the mask with least additional cost incurred and least part to be removed in the middle of the process by using the margins cut out. A grip 30 is formed on each side of the first mid seam line 25 of the first fold section 24 of the main body. The grips help a user handle the mask sanitarily. A shell 34 having a middle opening is joined to the innermost side of the main body. The shell is made of a soft elastic material to increase wearing comfort.

Figure 5:
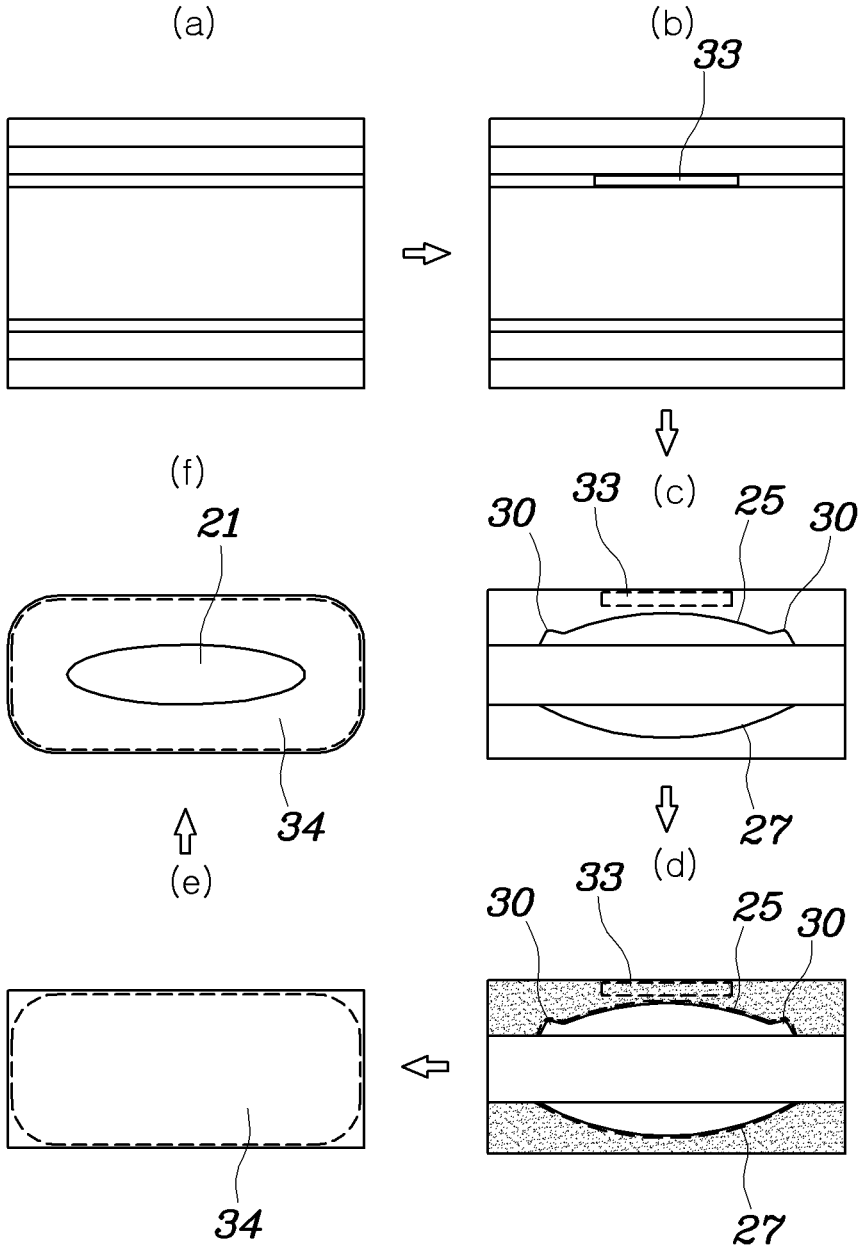
FIG. 5 is a schematic diagram showing a process of fabricating the mask of FIG. 2.
Figure 6:
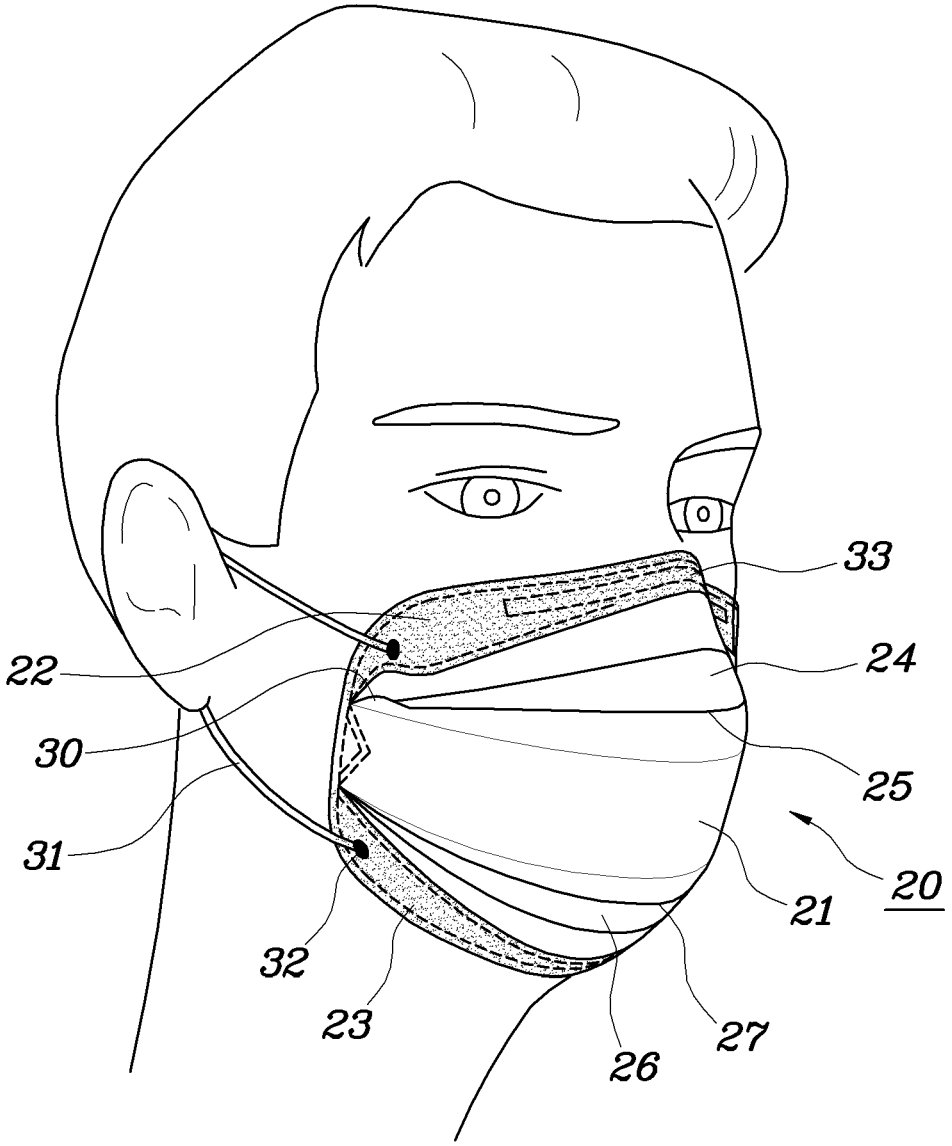
FIG. 6 is a perspective view showing a donning state of the mask of FIG. 2.

Referring to FIG. 5 to make the features of the present invention clear, a nose clip 33 is embedded (step b) when a raw panel is prepared by layering sheets having various functions (step a). The upper and the lower portions of the layered panel are folded, cut in arc and bonded to form the first mid seam line 25 and the second mid seam line 27 respectively (step c). The marginal portions cut out in this process are not separated or removed from the panel. Further, if necessary, the grips 30 are formed on the first fold section. The folded portions are refolded again along the horizontal fold lines respectively. The refolded portions and the marginal portions cut out are bonded over the first mid seam line 25 and under the first mid seam line 27 respectively, as indicated by the dotted line (step d). If necessary, the mask is turned inside out and a sheet made of an elastic material is bonded to form the shell 34 on the innermost side of the mask (step e). The main body is completed by trimming the edges after forming an opening in the shell (step f). The upper lobe 22 and the lower lobe 23 have reinforced rims triple as thick as the raw panel.

The fold sections 24 and 26 extending from the middle lobe upward and downward have mid seam lines 25 and 27 respectively, and are bounded by corresponding horizontal fold lines. They are cut from the initial folded portions, and thus are neatly folded without overlapping the rims which are reinforced with the marginal portions cut out from the initial folded portions to be triple as thick as the raw panel.

The shell 34 disposed on the innermost side of the mask lessens uncomfortable feel which would be caused by the nose clip and increase wearing comfort.

INDUSTRIAL APPLICABILITY

The horizontally flat-foldable mask having five surfaces according to the present invention can be widely used to block contaminated air in normal life or protect the respiratory organs of a wearer from noxious gases at industrial sites.

The invention claimed is:

1. A horizontally flat-foldable mask, the mask comprising:

a main body having, in a flat folded state, a middle lobe, an upper lobe, a lower lobe, a first fold member extending upward from the middle lobe, horizontally folded from the upper lobe and having a first mid seam line curved or inclined downward from a center toward both sides, and a second fold member extending downward from the middle lobe, horizontally folded from the lower lobe and having a second mid seam line curved or inclined upward from the center toward both sides; and harnesses fixed to both sides of the main body, wherein the first fold member is fully folded using the first mid seam line as a first fold line and the second fold member is fully folded using the second mid seam line as a second fold line.

2. The horizontally flat-foldable mask of claim 1, wherein edges of the upper lobe and the lower lobe have rims reinforced by marginal portions cut out in the course of forming the first fold member and the second fold member, respectively.

3. The horizontally flat-foldable mask of claim 1, wherein the main body further comprises a shell with an opening, the shell being joined to an innermost side of the main body.

4. The horizontally flat-foldable mask of claim 1, wherein the first fold member of the main body has grips on each side thereof.

* * * * *